US011319037B2

(12) United States Patent
Grall

(10) Patent No.: US 11,319,037 B2
(45) Date of Patent: May 3, 2022

(54) FLOATING MARITIME VESSEL COMPRISING A DETACHABLE MEASURING KEEL

(71) Applicant: IXBLUE, Saint-Germain-en-Laye (FR)

(72) Inventor: Sébastien Grall, Aubagne (FR)

(73) Assignee: IXBLUE, Saint-Germain-en-Laye (FR)

( * ) Notice: Subject to any disclaimer, the term of this patent is extended or adjusted under 35 U.S.C. 154(b) by 0 days.

(21) Appl. No.: 16/768,758

(22) PCT Filed: Nov. 30, 2018

(86) PCT No.: PCT/FR2018/053056
§ 371 (c)(1),
(2) Date: Jun. 1, 2020

(87) PCT Pub. No.: WO2019/106314
PCT Pub. Date: Jun. 6, 2019

(65) Prior Publication Data

US 2021/0171166 A1 Jun. 10, 2021

(30) Foreign Application Priority Data

Dec. 1, 2017 (FR) ..... 1761547

(51) Int. Cl.
*B63B 41/00* (2006.01)
*B63B 79/10* (2020.01)
(Continued)

(52) U.S. Cl.
CPC ..... *B63B 41/00* (2013.01); *B63B 1/04* (2013.01); *B63B 1/24* (2013.01); *B63B 3/38* (2013.01);
(Continued)

(58) Field of Classification Search
CPC .. B63B 41/00; B63B 1/04; B63B 1/24; B63B 3/38; B63B 3/48; B63B 2041/003
See application file for complete search history.

(56) References Cited

U.S. PATENT DOCUMENTS 4,538,539 A 9/1985 Martin
5,431,121 A * 7/1995 Canepa ..... B63B 41/00 114/102.15
(Continued)

FOREIGN PATENT DOCUMENTS

DE 84 11 433 8/1984
JP 61 253289 11/1986
(Continued)

OTHER PUBLICATIONS

International Search Report, PCT/FR2018/053056, dated Mar. 1, 2019.

*Primary Examiner* — Anthony D Wiest
(74) *Attorney, Agent, or Firm* — Nixon & Vanderhye

(57) ABSTRACT

The invention relates to a floating maritime vessel including at least one hull beneath a deck, the hull extending between a bow and a stern in a longitudinal direction of the vessel, the vessel including, on its lower part, a removable keel and, on its upper part, a conning tower erected above the deck, the keel being able to be descended below the hull and raised back through the hull, the keel including a lower end and an upper end, the upper end of the keel connecting to the hull when the keel is in its lowered position. According to the invention, the conning tower contains a keel-storage space and the keel and the keel-storage space of the conning tower are aligned such that the keel can be raised by upward translation at least partly into the keel-storage space of the conning tower.

20 Claims, 8 Drawing Sheets

(51) Int. Cl.

| | |
|---|---|
| ***B63B 1/04*** | (2006.01) |
| ***B63B 3/38*** | (2006.01) |
| ***B63B 3/48*** | (2006.01) |
| ***B63H 21/17*** | (2006.01) |
| ***B63B 1/24*** | (2020.01) |

(52) U.S. Cl.
CPC ..... *B63B 3/48* (2013.01); *B63B 79/10* (2020.01); *B63H 21/17* (2013.01)

(56) References Cited

U.S. PATENT DOCUMENTS

| | | | | |
|---|---|---|---|---|
| 9,302,741 | B2 * | 4/2016 | Hinkel ..... | B63B 3/38 |
| 2010/0279563 | A1 | 11/2010 | Heard et al. | |
| 2014/0261126 | A1 | 9/2014 | Jenkins | |
| 2015/0210359 | A1 | 7/2015 | McClure | |

FOREIGN PATENT DOCUMENTS

| | | |
|---|---|---|
| SU | 1 154 142 | 5/1985 |
| WO | WO 2016/144124 | 9/2016 |

* cited by examiner

FLOATING MARITIME VESSEL COMPRISING A DETACHABLE MEASURING KEEL

BACKGROUND OF THE INVENTION

Field of the Invention

The present invention generally relates to the field of watercrafts, in particular marine crafts. More particularly, it relates to a floating marine craft provided with a removable keel. It applies in particular to marine exploration with measuring crafts, and in particular a craft that is an unmanned or crewless drone.

Description of the Related Art

For marine exploration, measuring devices are used, generally sonars, which are located underwater. These measuring devices can be towed behind a ship, but it has also been proposed to use crafts or drones including such measuring devices and having autonomous and/or remote-controlled propulsion and navigation means. These crafts or drones are of relatively small size and, in case of drones, have no crew.

The floating crafts or drones can have appendices under their hull to perform various functions, sometimes combined with each other: anti-drift, ballast or equipment support. Hereinafter, these appendices will be generically called "keel".

In the wind-driven floating crafts or drones, the keel is used for these anti-drift and ballast functions, in order to counter the capsizing torque exerted by the sails.

In the power-driven floating crafts or drones, the keel is used for these anti-drift functions but not for the ballast. Indeed, the transverse stability of the power-driven floating crafts or drones is above all provided by the hull shape itself and more specifically the large width thereof. For this reason, the keels, generally called "bilge keels", present on the power-driven crafts are shallow.

The exploration drone is generally brought on the exploration site by a ship that takes it back at the end of the exploration. Between the exploration periods in which it is on the sea, the drone is brought-back on the ship. The keel may be troublesome during recovery and launch operations and, also, for its storage on the ship.

Moreover, these keels, which are located under the craft or drone underwater hull, by increasing its vertical depth or draught. It may be useful to be able to reduce this draught in certain circumstances and one of the solutions commonly adopted consists in that these keels are liftable, that is to say that, thanks to a mechanical means and a guiding system, the keel can be fully or partially retracted inside the craft or drone hull.

In certain cases, these keels are of so great-size that, once lifted, they protrude upward from the upper surface of the deck. In this case, they create a wind resistance and they clutter the decks.

Moreover, certain crafts or drones comprise an appendix or a series of appendices arranged in elevation above the deck and/or the superstructures. These elevated appendices, which may be called "masting" or wheelhouse, these terms being equivalent in the context of the invention, serve in functions that are necessary to crafts or drones, such as supporting different pieces of equipment: navigation lights, communication antennas, radars, flags . . . , motor exhausts, ventilation input/output, tank vents . . . .

Documents SU-1.154.142A1 relating to a sailboat with a centre-board able to be lifted through the hull, WO-2016/144124A1 relating to a ship with "airbag" and mobile weights intended to prevent that a distressed ship lists too much and sinks, and U.S. Pat. No. 4,538,539A relating to a ship with a deformable keel for hydrodynamic modifications are known. Following documents are also known: US 2014/261126 A1 that is related to a sailing boat with a rigid wing; US 2010/279563 A1 that discloses a fin attachment magnetic system; JP S61 253289 A that is related to a sailing boat with an improved keel and DE 84 11 433 U1 that discloses a sailing boat with a rocking keel. Generally, the power-driven ships have hulls of different shapes than those of the sailboats and these power-driven ships have no ballasted keel due to the fact they do not have to counter a torque created by the wind on a sail of a mast.

SUMMARY OF THE INVENTION

In order to remedy the above-mentioned drawbacks or even others, the present invention proposes a marine craft that comprises a removable keel facilitating the launch and recovery operations as well as the storage, but also providing the craft with several navigation modes as a function of the keel position. Moreover, in operation, the keel in lifted position has no longer impact on the wind resistance and does no longer clutter the deck thanks to the fact that it is lifted within the wheelhouse or masting, which internally contains a keel-storage space that receives the part of the lifted keel that would otherwise protrude from the deck or the superstructures. Due to their immersed position, the keels may advantageously be equipped with measuring devices.

More particularly, it is proposed according to the invention a floating marine craft comprising at least one hull topped with a deck, the hull extending between a bow and a stern along a longitudinal direction of the craft, the craft comprising, in its lower part, a removable keel, and in its upper part, a wheelhouse erected above the deck, the keel being able to be lowered under the hull and lifted through the hull, the keel having a lower end and an upper end, the upper end of the keel being connected to the hull when the keel is in lowered position.

According to the invention, the wheelhouse internally contains a keel-storage space, and the keel and the keel-storage space are arranged in alignment with each other so that the keel can be lifted by upward translation at least partly into the keel-storage space of the wheelhouse.

The term "marine" in marine craft must be considered in a broad sense, which can relate both a craft adapted to sea or ocean and a craft for lakes, rivers or other stretches of water.

Other non-limitative and advantageous features of the craft according to the invention, taken individually or according to all the technically possible combinations, are the following:

- the deck corresponds to the upper level, out of water and in the open air, of the craft,
- the floating marine craft is an exploration craft,
- the removable keel is a removable measuring keel comprising at least measuring instruments,
- the hull acts as a float,
- the keel and the keel-storage space of the wheelhouse have aligned main axes that are vertical,
- the keel and the keel-storage space of the wheelhouse have aligned main axes that are inclined with respect to the vertical, the keel and the keel-storage space of the wheelhouse have aligned main axes that are perpendicular to the main longitudinal extent of the craft, the keel and the keel-storage space of the wheelhouse have aligned main axes that are inclined with respect to the main longitudinal extent of the craft, the main axis of the wheelhouse and the main axis of the keel-storage space of the wheelhouse are parallel and preferably collinear, the wheelhouse comprises, in its lower part, the keel-storage space, and in its upper part, pieces of equipment, the keel includes, in its lower end, a longitudinally elongated bulb connected to the upper end of the keel by a connection part of the keel of longitudinal extent lower than the longitudinal extent of the bulb, and when the keel is lifted within the wheelhouse, the bulb remains under the hull, the bulb is integral with the keel connection part and, when the keel is lifted within the wheelhouse, the bulb remains under the hull, the bulb can be disconnected from the keel connection part and, when the keel is lifted within the wheelhouse, the disconnected bulb remains under the hull, the bulb includes at least measuring instruments, the craft is intended to perform acoustic measurements and comprises acoustic measurement systems comprising acoustic wave transmitting and receiving transducers, and at least the acoustic wave transmitting and receiving transducers are arranged in the bulb of the keel, the craft comprises an attitude measurement unit comprising attitude measurement sensors and at least attitude measurement sensors are arranged in the bulb of the keel, the maximum width of the keel connection part is lower than or equal to the maximum width of the bulb, the maximum length of the connection part being lower than the maximum length of the bulb, said length and width being considered along, respectively, the longitudinal direction of the craft and a horizontal transverse direction perpendicular to the longitudinal direction, the ratio of the maximum width of the connection part to the maximum width of the bulb is comprised between 0.05 and 0.5, the keel connection part has a substantially identical length over its whole height, the keel connection part has a substantially identical maximum width over its whole height, the keel connection part has a uniform cross-section over its height, the transverse cross-section of the keel connection part is circular, ovoid or fusiform, the hull comprises a keel well, allowing at least the downward and upward passage of the keel, the keel-storage space of the wheelhouse is in alignment with a keel well opening downward through the hull and whose walls raise up above the waterline of the craft, wherein the keel can slide within said keel well, the keel well is flooded up to the waterline level, the craft comprises sealing means between the keel connection part and the hull in order to create in the keel well a space located under the waterline that is out-of-water, a seal flexible skirt extends between the upper end of the keel and the hull, a seal flexible skirt extends between the lower end of the keel connection part and the hull, the flexible skirt is a wrinkled skirt, the flexible skirt is elastic, the bulb comprises an upper face turned upward and towards the hull and a lower face turned downward and the hull comprises a recess at the connection of the hull with the keel, said recess being able to accommodate at least the upper face of the bulb when the keel is lifted, the hull recess can accommodate the bulb in totality when the keel is lifted, the bulb being then comprised within the general volume of the hull, the craft is a drone, the craft is single-hull, the craft is single-hull and comprises a substantially fusiform hull with a tapered stem in order to form a wave-piercing floating craft, the deck has an upwardly convex surface, the bow tapers into a point, the bow tapers into a blade, the stern is planar, the single-hull craft has a total width to total length ratio lower than 0.2 and a maximum length lower than 20 metres, said length and width being considered, respectively, along the longitudinal direction of the craft and a horizontal transverse direction perpendicular to the longitudinal direction, the single-hull craft has a ratio of the height above the waterline of the hull acting as a float and without its potential appendices, hence without the wheelhouse, to the height under the waterline of the hull acting as a float and without its potential appendices, hence without the keel, that is lower than 0.8 and higher than 0.1, the craft has a length of at least 2.5 metres, the wheelhouse is in part intended to receive the keel and the keel-storage space of the wheelhouse represents at least 75% of the whole volume of the wheelhouse, the height of the wheelhouse placed on the deck or the superstructures of the ship is such that the top thereof is located at a minimum altitude of 1.5 metres above the deck when the ship is vertical, the wheelhouse may be closed over its whole surface, the wheelhouse may be open over a part of its surface, the wheelhouse has an aerodynamic shape, the wheelhouse has a height (with respect to its base) to width (in the transverse direction with respect to the displacement axis of the ship) ratio higher than 3, the hull maximum height measured from lowermost point of the hull, without the keel, to the uppermost point of the hull, without the wheelhouse, is lower than the keel height, the hull height, hence without the keel and the wheelhouse, measured along an alignment axis passing through the lowered keel and the wheelhouse is lower than the keel height, the craft has a motor-driven propulsion, the motor-driven propulsion comprises at least one electric motor and/or internal combustion engine, operating, directly or indirectly, one or several propellers or one or several turbines, the motor-driven propulsion is mixed, at least one internal combustion engine operating at least one electric generator that, in turn, powers at least one electric motor directly operating one or several propellers or one or several turbines, the internal combustion engine hence indirectly operating one or several propellers or one or several turbines, in the case of a motor-driven propulsion with an electric motor, the craft further comprises rechargeable batteries storing electrical energy intended to the electric motor(s) directly operating one or several propellers or one or several turbines, the craft comprises on the deck and/or on the wheelhouse photovoltaic cells intended to recharge the rechargeable batteries, the craft has no pilot on-board, the craft has no crew, the craft is autonomous, the craft is remote-controlled, the craft comprises at least one propeller and navigation members, the craft is a drone comprising remote-controlled and/or preprogrammed computer navigation pieces of equipment, the hull comprises an immersed lower part or underwater hull, and the lowered keel exits downward from said immersed lower part of the hull, the hull comprises a non-immersed lower part, and the lowered keel exits downward from said non-immersed lower part of the hull, the lowered keel then having, upward, a non-immersed part, the craft comprises a mechanism for lifting and lowering the keel, said mechanism being at least motor-driven, the craft comprises a means for locking the keel, immobilizing the keel with respect to the hull (more generally with respect to the remaining of the craft), the craft comprises a means for locking the keel in lowered position, the craft comprises a means for locking the keel in lifted position, the keel is adjustable in height under the hull so as to be able to adjust the depth of the bulb with respect to the hull, the craft comprises a means for locking the keel in at least one intermediate keel position between the lifted position and the lowered position, the keel is interchangeable, the locking means is without material link between the interlocked parts, the locking means is magnetic and controlled, the magnetic locking means including at least two independent complementary parts magnetically interacting with each other, one of the parts being arranged on the keel side, and the other part, functionally complementary, being arranged on the hull side and, potentially, on the wheelhouse side, each of the two parts of the controlled magnetic locking means is chosen complementarily among one or several of the magnets, the electromagnets, the ferromagnetic parts, so that they can attract each other, repel each other or, potentially, have no magnetic interaction left, as a function of the commands, the parts on the hull and, potentially, on the wheelhouse, are fixed, the parts on the hull are arranged in the keel well, the parts on the keel are fixed on the keel but mobile with respect to the hull and to the wheelhouse due to the mobility of the keel with respect to the hull, a same part of the keel is used with at least two complementary parts of the hull and/or the wheelhouse for locking the keel in the at least lowered and lifted positions, the keel part moving with the keel to come into relation with the fixed complementary part of the hull and, potentially, of the wheelhouse, a command allows the mutual attraction between the two parts of the magnetic locking means, a command allows the mutual repulsion between the two parts of the magnetic locking means, a command allows eliminating the attraction or repulsion magnetic interaction between the two parts of the magnetic locking means, one of the two parts of the locking means is an electromagnet and the other complementary part is an electromagnet or a ferromagnetic part, the ferromagnetic part is a permanent magnet, at least one of the two parts of the locking means further comprises a permanent magnet, the upper end of the keel connection part comprises the first part of the locking means and the craft comprises at least one second complementary part, the first and the second corresponding parts coming into functional correspondence with each other when the keel is lowered and/or lifted, wherein the first and second parts can at least attract each other as a function of a locking command, the functional correspondence being a face-to-face of the first and second parts allowing a magnetic interaction between each other, the keel can comprise intermediate positions between the lowered position and the lifted position, the intermediate position(s) are lockable, the second part is in the wheelhouse to allow the locking of the keel in lifted position, the second part is in the hull or in close relationship with the latter, in particular in the lower part of the keel well of the hull, to allow the locking of the keel in the lowered position, the locking is active, the locking command having to be maintained to maintain the locking, the locking is passive, the unlocking command having to be stopped to ensure the locking, the unlocking is active, the unlocking command having to be maintained to maintain the unlocking, the unlocking is passive, the locking command having to be stopped to ensure the unlocking, at least one of the two parts of the magnetic locking means is an electromagnet, the command being ensured by an electrical current, the bulb has a bow end and a stern end, and the bulb is tilting at the lower end of the keel connection part so as to place the bulb and the connecting part and the cross-sectional shape of the bulb in axial continuity, said cross-section being perpendicular to the longitudinal extent of the bulb, and the cross-sectional shape of the keel connection part being adapted so as to allow the lifting of the bulb at least into the keel well, the bulb has a bow end and a stern end, and the bulb is tilting at the lower end of the keel connection part so as to place the bulb and the connecting part and the cross-sectional shape of the bulb in axial continuity, said cross-section being perpendicular to the longitudinal extent of the bulb, and the cross-sectional shape of the keel connection part being adapted so as to allow the lifting of the bulb and at least one of the two bow or stern ends of the bulb into the storage space of the wheelhouse, the adaptation between the cross-sectional shapes of the keel connection part and of the bulb corresponds to the fact that the tilted bulb is included in the downward prolongation of the keel connection part volume, at least a lower part of the rear edge of the keel connecting part is open in order to accommodate a part of the tilted bulb in the connecting part volume, the keel connection part is fully lifted within the hull, the keel connection part is fully lifted within the wheelhouse, the tilting bulb is fully lifted within the hull, the tilting bulb is fully lifted within the wheelhouse, the keel connecting part and the bulb comprise a means for locking the bulb in tilted position and in non-tilted position, the one or several means for locking the bulb in tilted position and in non-tilted position are electromagnetic, in the non-tilted position of the bulb, the longitudinal extent of the bulb is substantially parallel to the longitudinal extent of the craft, in the tilted position of the bulb, the longitudinal extent of the bulb is substantially parallel to the keel connection part, the keel with a bulb able to tilt comprises bulb tilting members that are motor-driven and controlled, the keel can comprise one or several mobile flaps, the keel lower part comprises one or several trailing edge flaps in order to dynamically act on the transverse trim of the craft, the trailing edge flaps are mobile, the trailing edge flaps are retractable in order to enter into the general external volume of the keel connection part and to be able to be lifted into at least the keel well, the mobile flap(s) of the keel may be piloted in order to have an influence on the transverse stability of the craft, the mobile flap(s) may be controlled by an attitude unit of the craft.

BRIEF DESCRIPTION OF THE DRAWINGS

The following description in relation with the appended drawings, given by way of non-limitative example, will allow a good understanding of what the invention consists of and of how it can be implemented.

In the appended drawings.

DESCRIPTION OF THE PREFERRED EMBODIMENTS

By way of exemplary embodiment, it is considered a drone intended to perform marine explorations with measurements performed by measuring devices installed in the keel bulb.

Figure 1:
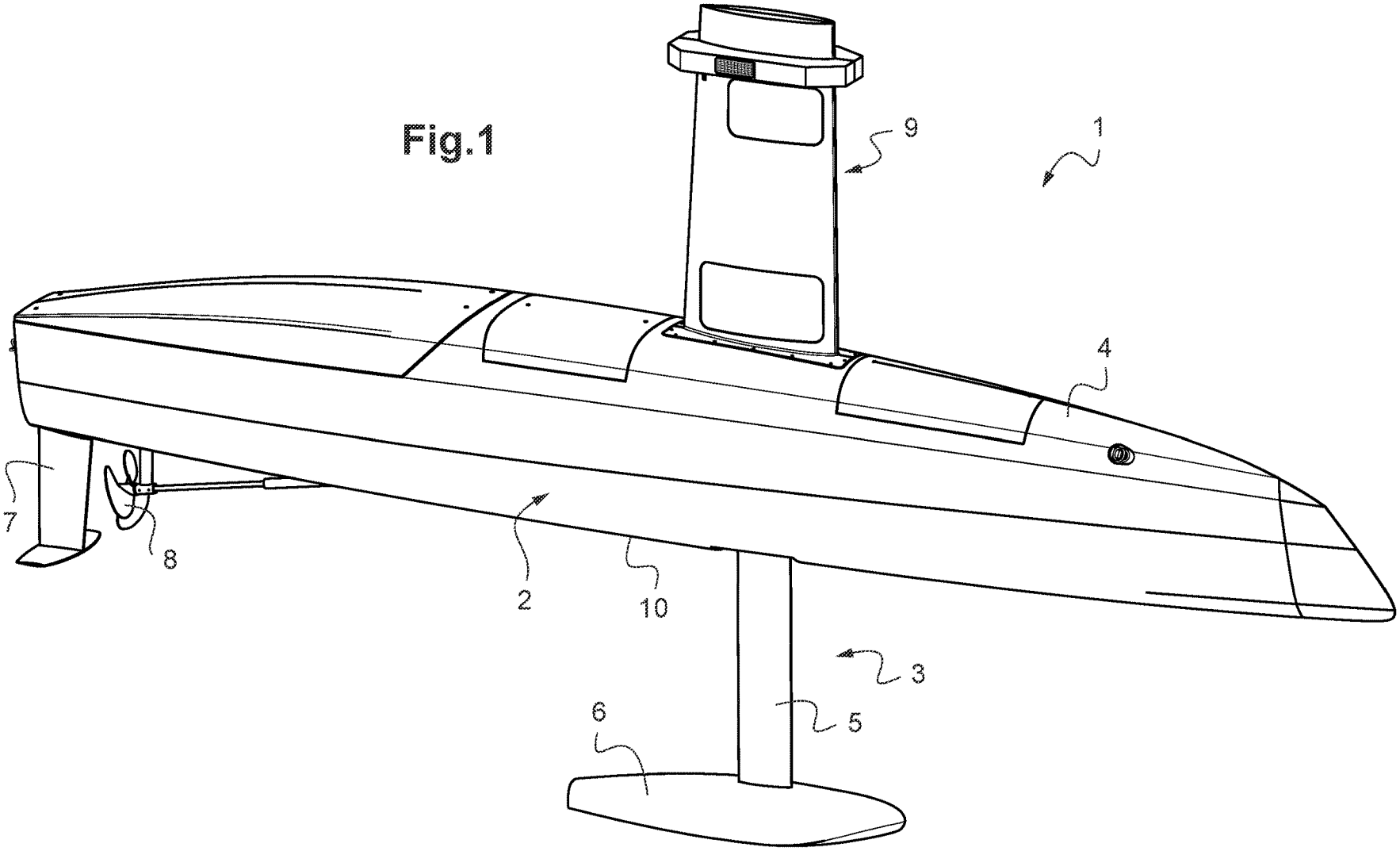
FIG. 1 is a perspective view of a drone whose keel is lowered.

In FIG. 1 is shown the floating/surface drone 1 of the invention, which is power-driven, herein with a propeller 8, and which comprises a very narrow fusiform hull 2. This very narrow hull does not provide a transverse stability to the craft 1, which has a very tapered shape so that, with this tapered stern hull, a wave-piercing craft is obtained. The underwater hull 10, the dead works and the deck 4 are hence configured to be of the "wave-piercing" type.

Towards the bottom of the hull 2, at the lower part of the underwater hull 10, is installed a keel 3 with a bulb 6. The bulb 6 being at the lower end of the keel 3, it is connected to the hull by a connecting part 5 of the keel 3. The keel 3 with a bulb 6 comprises, preferably in the bulb 6, a ballast that provides the transverse stability to the craft 1. This ballast is a specific heavy material, for example lead or tungsten, and/or corresponds to pieces of equipment, in particular measuring devices, installed in the bulb 6.

The craft 1 also comprises, in this example, a rudder 7.

Thanks to the very narrow shape of the hull 2 also visible in FIGS. 1 to 3 and 5, the craft 1 has a very low resistance to forward motion in view of its length. The hull 2 with the keel 3 allows minimizing the pitch movements. The hull 2 is capable of exceeding with very little energy the limit speed of the underwater hull and to reach overspeed without thereby having a so-called "hovering" shape.

The craft 1, whose total length is lower than 20 metres and with a minimum length of at least 2.5 metres, has a total width to total length ratio lower than 0.2. Preferably, the drone of the shown example has a length comprised between 2.5 m and 20 m.

The surface craft 1 of the invention, with its fusiform hull, is hence different from the traditional power-driven ships, which have a geometry that provides them with a shape stability aiming at maintaining the horizontal trim of the ship during the displacement of the masses taken onboard and during the movements generated by the sea or the ocean.

The elements of the craft 1 located above the waterline and in particular those located on the deck 4 have a relatively reduced height, or at least a reduced proper weight, so that the centre of gravity of the craft with its keel lowered down is very low and so that it offers a small wind resistance. The craft has no sail, mast or rigging, or any other equipment intended to use the wind force. It has hence a low radar echo due to its shape, size and to the small height of the emerged parts.

Although the craft does not use the wind for its propulsion and hence has no mast or another elevated appendix dedicated to the use of wind for propulsion, the craft can however comprise a wheelhouse 9 or a masting serving in particular to carry the radio and/or optical and/or wind generator and/or sensor pieces of equipment, as well as to place as high as possible the potential air intakes useful for certain operating modes of the drone.

The outer walls of the hull 2 and of the wheelhouse 9, preferably in their non-immersed parts, comprise access doors permitting access to the inside of some compartments of the craft 1.

The materials constituting the craft, in particular its hull 2 and its wheelhouse 9, may be chosen as a function of the needs. For example, metals can be used for the hull 2 and/or the wheelhouse 9 to keep a radar echo, or composite materials, in particular glass fibre, can be used in the opposite case.

The craft 1, which is not a reduced model of an existing ship, is herein a drone intended to perform sonar acoustic measurements, wherein the acoustic measuring systems, in particular the acoustic wave transmitting and receiving transducers, are arranged in the bulb of the keel 3. Moreover, the keel 3, in particular its bulb 6, also comprises an attitude unit that allows accurate corrections of the acoustic measurements due to the fact that this attitude unit is positioned as close as possible to the acoustic transducers.

This craft 1 is autonomous in that it comprises power-driven propulsion means 8 and an internal source of energy. It is hence not a towed device and/or a device connected by a cable to a ship or another equipment, floating or not. In a variant implementation, it can be towed.

Thanks to the shape of the hull 2 of the craft 1, the resistance to forward motion is reduced both in calm water and in rough water, and a reduction of the movements generated on the craft 1 by the agitation of the waves is obtained. The shape of the craft 1 and of its keel 3 allows improving the flow about its acoustic transducers and avoids the formation of bubbles having a masking effect at the acoustic transducers. It results therefrom a diminution of the "noises" that, in the traditional ships, cause interference to the acoustic measurements.

The drone is hence power-driven and at least one electric motor or internal combustion/chemical reaction engine or even mixed engine is used, which can operate a propeller 8 or, in variants, several propellers or one or several turbines.

Figure 2:
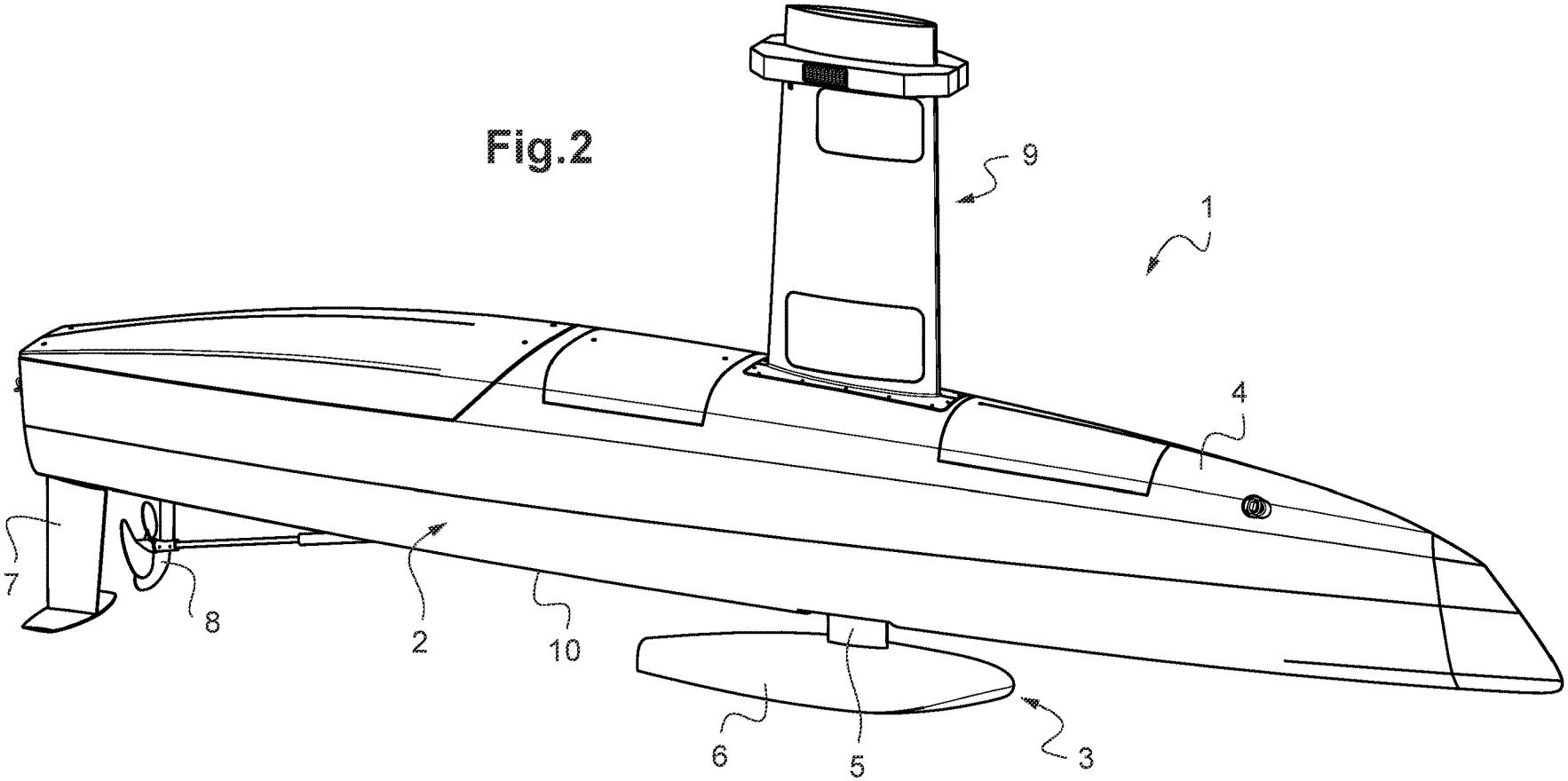
FIG. 2 is a perspective view of the drone of FIG. 1, whose keel is lifted.

The keel 3 can be lowered and lifted, preferably more or less highly lifted, so as to be able, in particular, to choose the draught of the craft. In FIG. 2, the keel 3 has been lifted and the bulb 6 remains under the hull 2, the greatest part of the height of the connection part 5 of the keel 3 having slid inside the craft hull and even, for the upper end of the connection part 5, having reached a keel-storage space 13 located inside the wheelhouse 9, as can be better seen in FIG. 5.

The wheelhouse 9 or masting hence comprises at least a hollow part that is voluminous enough to contain the part of the keel protruding from the deck or from the superstructures when the keel 3 is in lifted/upper position.

The wheelhouse 9 may have an aerodynamic shape and other functions than the only function of storing at least an upper part of the lifted keel.

In a preferred embodiment, the keel 3 is moreover dismountable and interchangeable. It is also preferred that the bulb 6 of the keel 3 is interchangeable from the keel so that the drone can be used with different configurations of acoustic transducers of various bulbs.

The hull comprises a keel well through which the keel is lowered down to the lower/exit position of the keel.

Figure 3:
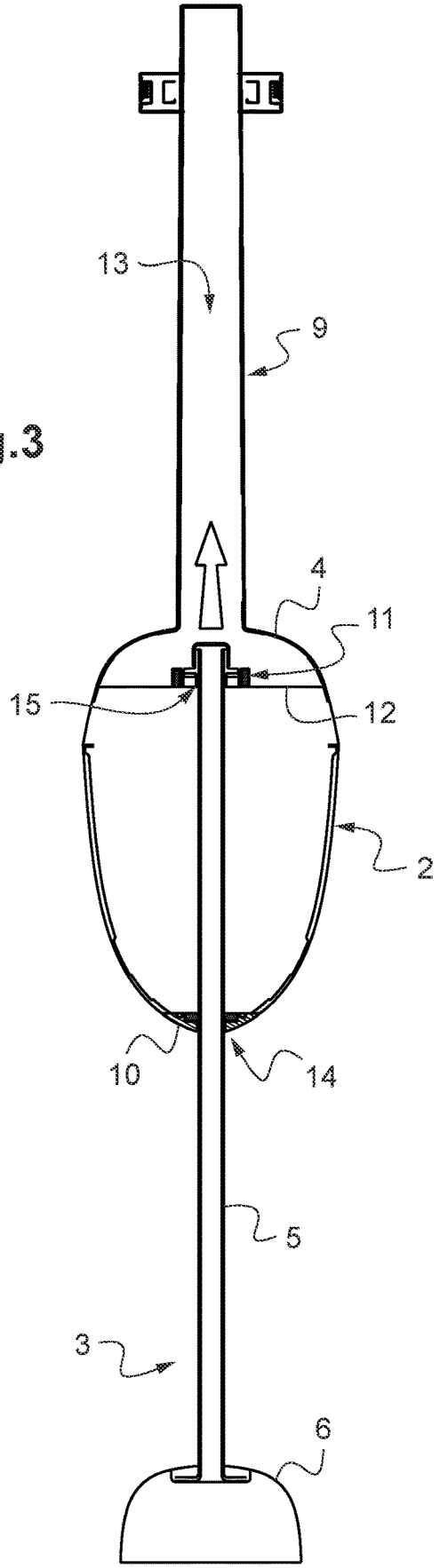
FIG. 3 is a cross-sectional view passing through the keel of the drone of FIG. 1 and whose keel is lowered.
Figure 5:
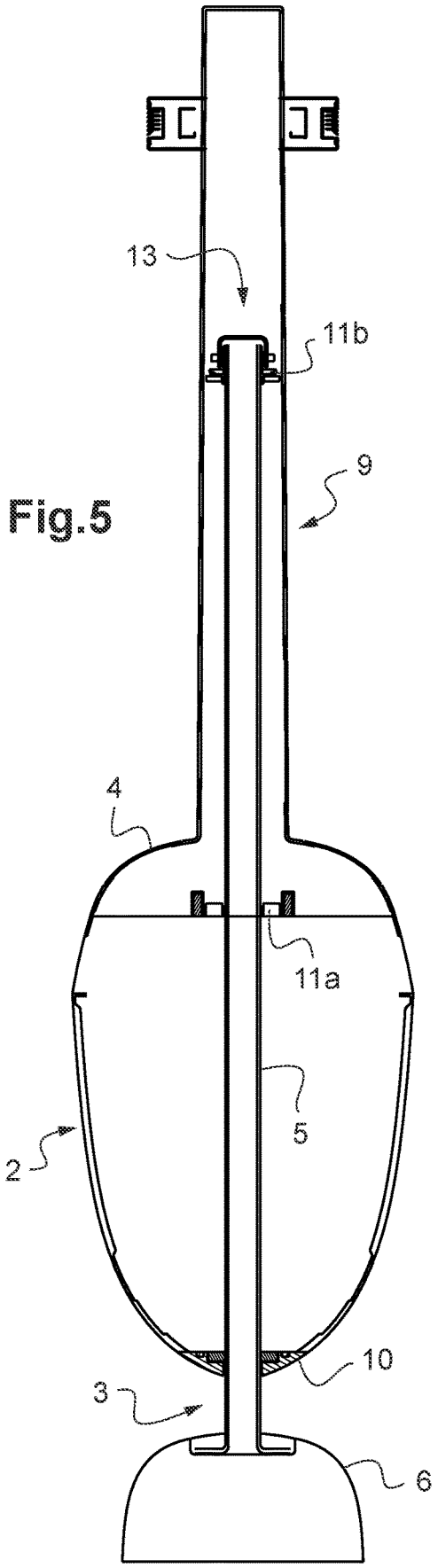
FIG. 5 is a cross-sectional view passing through the keel of the drone of FIG. 1 and whose keel is lifted.

This keel well may be materialized by a hollow column adjusted to the size and shape of the keel or may correspond to a wider area for the passage of the keel, or even correspond to a wide internal compartment of the craft. In the case where the keel well is not a column adjusted to the keel, as in the example shown in the figures, it is provided that the keel passes through at least two adjusted passages arranged at different heights so as to allow an effective lifting and lowering guiding of the keel and to stabilize it along a stable vertical (or near vertical) axis, once in place and locked at the desired height. In FIGS. 3 and 5, it can be seen that the lower adjusted passage 14 corresponds to the passage of the keel 3 through the bottom of the hull 2, wherein this passage allowing the sliding of the keel 3 can be sealed. Still in FIGS. 3 and 5, it can be seen that the upper adjusted passage 15 corresponds to the passage of the keel 3 through an internal tween deck 12 of the craft 1, wherein this passage allowing the sliding of the keel 3 can potentially also be sealed.

Guiding means are hence provided between the keel and the keel well and, possibly, the keel-storage space of the wheelhouse. The craft hence comprises keel guiding means that may be a sleeve, rails, bearings, slides . . . .

Preferably, the connection part 5 of the keel 3 that is located between, at the bottom, the bulb 6 and, at the top, the upper end of the keel, has a uniform cross-section over its height and the keel well of the hull and, possibly, the keel-storage space 13 of the wheelhouse, has/have also a uniform cross-section over its/their height and that, in addition, is adjusted to that of the keel connection part 5 to allow the guiding of the keel. This adjustment between the keel, in particular the keel connection part, and the keel well and, potentially, the keel-storage space of the wheelhouse, participates to the stable fastening between both and avoids that the keel "beats" with respect to the hull. As a variant, this guiding may, as in the example shown in the figures, be limited to two guiding passages 14, 15 or more, in which are located adjustments with the keel 3.

The liftable keel is hence mechanically guided in the keel well and, potentially, in the keel-storage space of the wheelhouse, in order to recover all the efforts other than those directed parallel to the keel lifting and lowering movement, so that a link of the "sliding" type is formed between the keel and the ship.

As can be seen in FIG. 3, the keel 3 can be lifted so as to be installed at least partly in a keel-storage space 13 inside the wheelhouse 9 or the masting.

In upper position of the keel, at least partly lifted within the wheelhouse, the keel may be locked in place using magnetic locking means (not shown for the upper position). Potentially, intermediate-height positions of the keel may also be locked using magnetic locking means (not shown).

The last degree of freedom remaining, in lifting and lowering of the keel, is hence locked by magnetic locking means allowing the keel to be locked at determined heights with respect to the hull. These determined heights are at least the lowered position of the keel and the lifted position of the keel corresponding to the amplitude of maximum vertical displacement of the keel.

The magnetic locking means are consisted of functional pairs, each comprising two magnetically complementary parts able to attract each other and/or repel each other and/or become magnetically inactive as a function of commands. One of the two parts is an electromagnet and the commands are performed using electrical currents.

Figure 4:
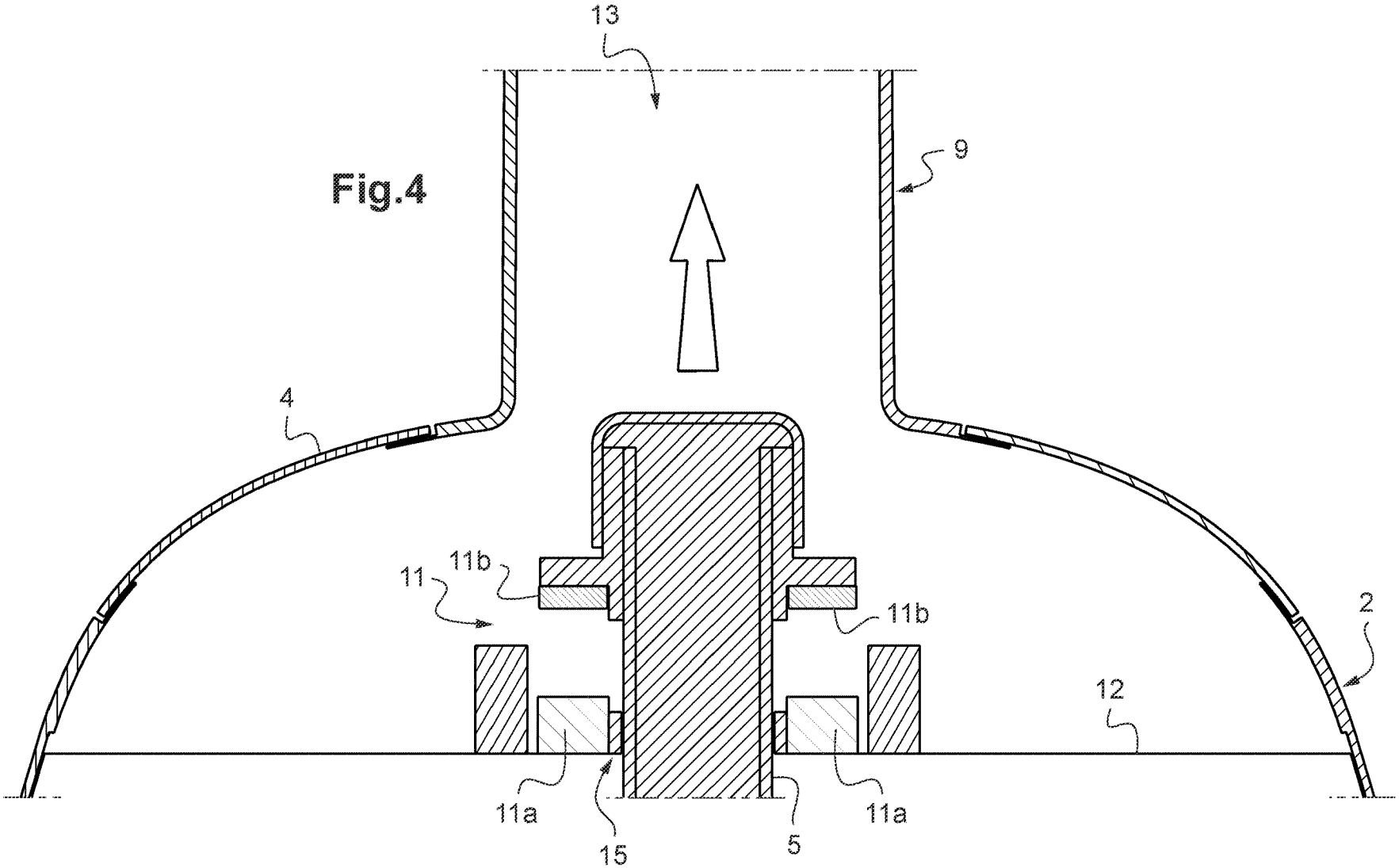
FIG. 4 is a cross-sectional view of an enlarged detail of the keel and of the drone of FIG. 1.

To simplify the figures, the magnetic locking means have been fully shown only for the locking in lowered position of the keel 3. Hence, in FIG. 3 in which the keel 3 is magnetically locked in lowered position, the magnetic locking means 11 is arranged in relation with the upper end of the connection part 5 of the keel 3 and with the tween deck 12. In FIG. 4, the magnetic locking means 11 has been unlocked to begin lifting the keel and in order to improve the visibility of the two parts 11*a* and 11*b* of the magnetic locking means 11 that have been separated. These two parts 11*a* and 11*b* form a magnetic suction cup herein arranged in relation with the adjusted passage 15 through the tween deck 12.

It is understood that a similar magnetic locking means (not shown) is implemented between the upper end of the connection part 5 of the keel 3 and the wheelhouse 9 in order to be able to lock the keel in lifted/upper position and that, for that purpose, the same part 11*b* can be used for locking the lowered position and the lifted position.

In variants, by way of security, manually activatable and deactivatable mechanical locking means may be additionally provided, and in particular for the upper/lifted position of the keel, these locking means being for example a pin fastening the walls of the connection part 5 and the wheelhouse 9 to each other.

The keel can also possibly be locked at intermediate heights between the two previous extreme positions, either at predetermined heights, wherein punctual locking means are installed at these predetermined heights, or at any heights. In this latter case, a vertical ferromagnetic plate is arranged along the keel well and an electromagnet arranged in the keel can circulate opposite the plate during the keel lifting and lowering operations, wherein the activation of the electromagnet causes an attraction with the plate that blocks the displacement of the keel at any desired position in height.

The locking with electromagnets may be of the "free under tension" or "closed under tension" mode, according to the embodiments.

In a simplified embodiment, the bulb remains under the hull, potentially protected within a recess of the hull, and does not pass through the keel well. In a more sophisticated embodiment, the bulb may also be lifted through the well, wherein the well is either configured to leave the passage to the bulb, or able to come in alignment with the keel connection part, for example by tilting, and to enter the projected volume of this connection part, the keel well having a shape adjusted to the volume of the keel connection part.

Figure 6:
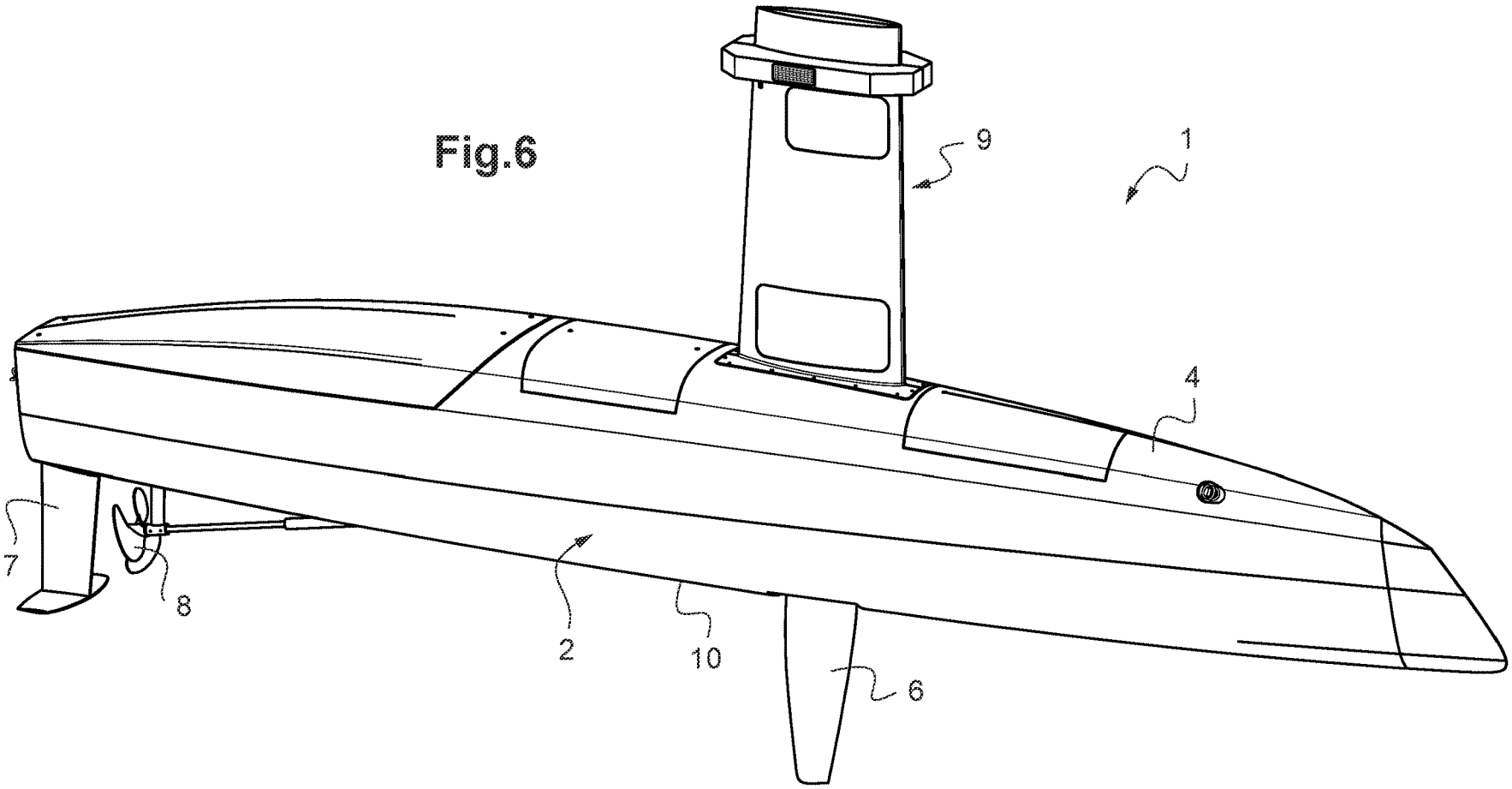
FIG. 6 is a perspective view of the drone of FIG. 1, having a keel that is lifted, the bulb of the keel being tiltable in the embodiment and being tilted, the bow end being upward.

In FIG. 6, an embodiment of the drone of FIG. 1 is represented. In the embodiment, the bulb 6 of the keel 3 is tiltable on the lower end of the connection part 5 of the keel 3. In FIG. 6, the bulb 6 of the keel 3 is tilted, the bow end being upward.

Figure 7:
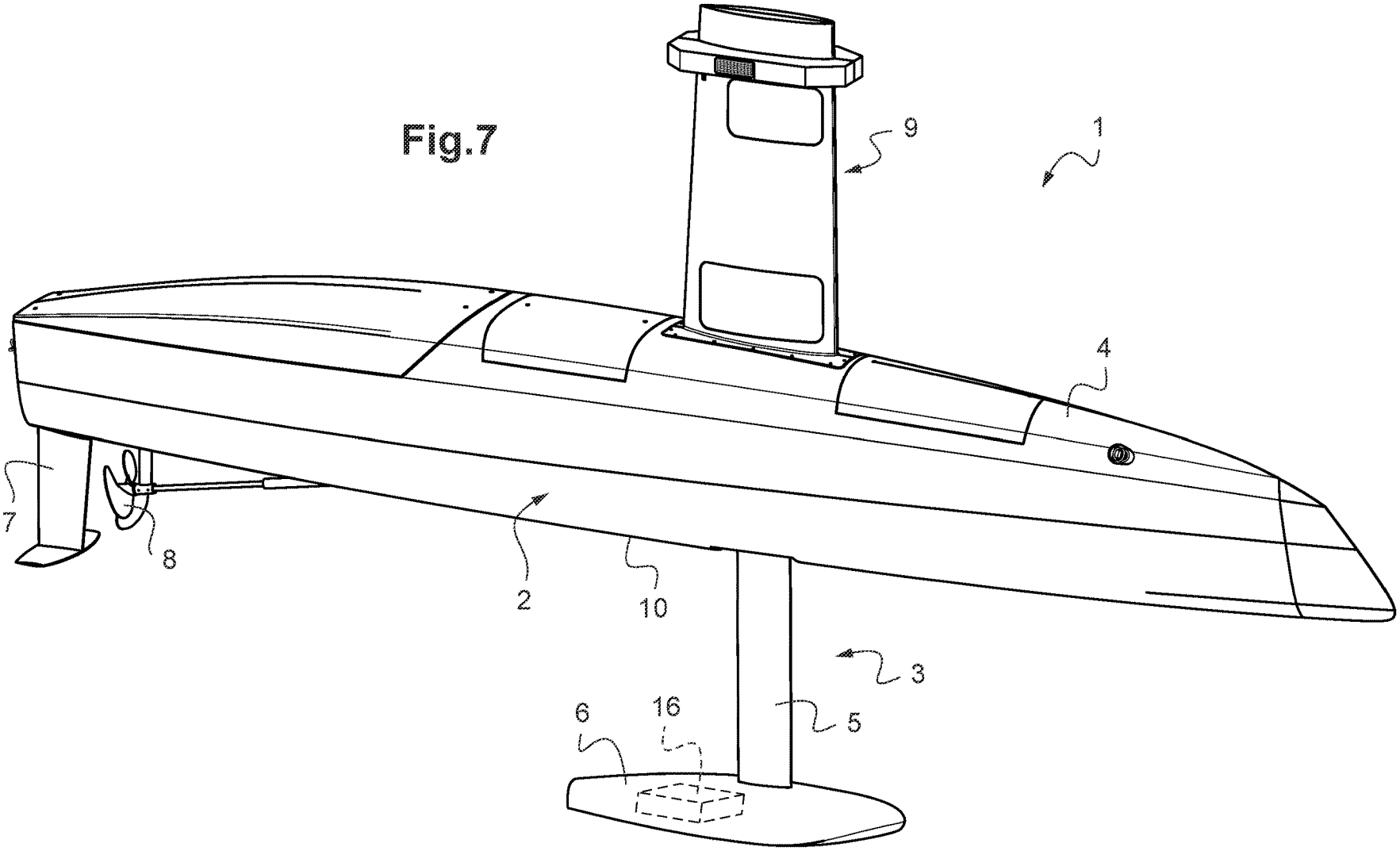
FIG. 7 is a perspective view of a drone having a keel that is lowered, the acoustic wave transmitting and receiving transducers in the bulb of the keel being represented by transparency through the walls of the bulb.

The drone is advantageously an exploration craft with a measuring keel including at least measuring instruments that are typically acoustic wave transmitting and receiving transducers that are in the bulb of the keep. In FIG. 7, the acoustic wave transmitting and receiving transducers 16 are shown by transparency through the walls of the bulb.

Figure 8:
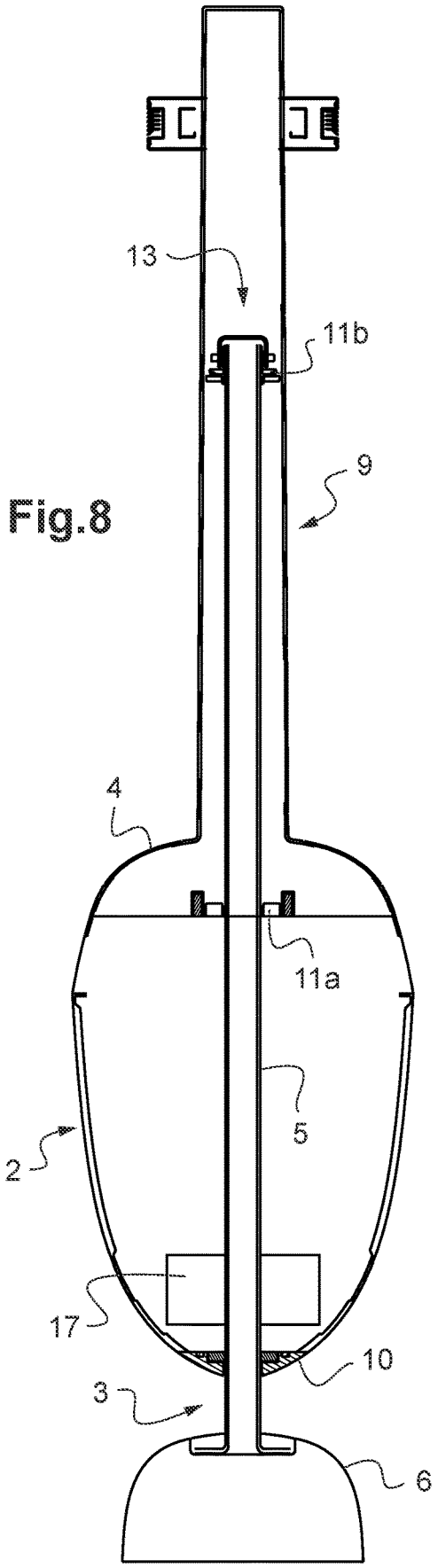
FIG. 8 is a cross-sectional view passing through the keel of the drone of FIG. 1, having a keel that is lifted, and on which the motor-driven mechanism to lower and lift the keel is illustrated.

As previously explained, the craft advantageously includes a mechanism for lifting and lowering the keel, the mechanism 17 that is at least motor-driven is represented in FIG. 8.

The lifting and the lowering of the keel through the hull and the keel well, and toward and from the keel-storage space of the wheelhouse, implements a motorization with a mechanical means (not shown) for the forced lifting: winch, hydraulic jack, rack, endless screw . . . and, possibly also for the forced lowering, and in this latter case, the height-position locking of the keel may be ensured by the mechanical means.

Preferably, by way of security, a descent stop is provided, preventing the keel from going down beyond the determined limit. This descent stop may be a wider part of the upper end of the keel, which comes into abutment against a stop placed at the lower end of the keel well or, as in the figures, arranged in relation with the passage 15 through the tween deck 12. This keel stop may be an element added at the upper end of the keel. The stop can also serve as an upper fitting bearing in lower position of the keel. The stop can support either the electromagnet(s), or magnetic parts on which the electromagnets can magnetically act by magnetic attraction or repulsion according to the embodiments. The mechanical guiding and the stops and abutments are designed in such a manner that the only forces to which the electromagnets are subjected are directed in the axis of lifting/lowering displacement of the keel.

The invention claimed is:

1. A floating marine craft comprising:

at least one hull topped with a deck, the at least one hull extending between a bow and a stern along a longitudinal direction of the craft, the at least one hull being fusiform and tapered;

a removable keel in a lower part of the craft, the removable keel configured to be lowered under the at least one hull and lifted through the at least one hull, the removable keel having a lower end and an upper end, the upper end of the removable keel being connected to the at least one hull when the removable keel is in a lowered position, the removable keel being a measuring keel comprising at least measuring instruments; and a wheelhouse erected above the deck in an upper part of the craft, the wheelhouse internally containing a keel-storage space, the removable keel and the keel-storage space of the wheelhouse being disposed in alignment with each other so that the removable keel is able to be lifted by upward translation at least partly into the keel-storage space of the wheelhouse, wherein the craft is an exploration craft, the craft being a motor-driven single-hull drone, the craft being wave-piercing, the craft having a total length lower than 20 meters and higher than 2.5 meters, with a total width to total length ratio lower than 0.2, the removable keel in the lowered position comprising a ballast providing transverse stability to the craft.

2. The craft according to claim 1, wherein the removable keel comprises, in the lower end, a longitudinally elongated bulb connected to the upper end of the removable keel by a connection part of the removable keel of longitudinal extent lower than the longitudinal extent of the bulb, and when the removable keel is lifted within the wheelhouse, the elongated bulb is configured to remain under the at least one hull.

3. The craft according to claim 2, wherein the connection part of the removable keel has a uniform cross-section over a height thereof.

4. The craft according to claim 3, wherein the bulb comprises an upper face turned upward and towards the at least one hull and a lower face turned downward, the at least one hull comprising a recess at the connection of the at least one hull with the removable keel, said recess being configured to accommodate at least the upper face of the bulb when the removable keel is lifted.

5. The craft according to claim 3, further comprising a mechanism configured to lift and lower the removable keel, said mechanism being at least motor-driven.

6. The craft according to claim 2, wherein the bulb comprises an upper face turned upward and towards the at least one hull and a lower face turned downward, the at least one hull comprising a recess at the connection of the at least one hull with the removable keel, said recess being configured to accommodate at least the upper face of the bulb when the removable keel is lifted.

7. The craft according to claim 6, further comprising a lock configured to lock the removable keel in a lifted position.

8. The craft according to claim 6, further comprising a mechanism configured to lift and lower the removable keel, said mechanism being at least motor-driven.

9. The craft according to claim 2, wherein the bulb comprises a bow end and a stern end, the bulb being configured to tilt at the lower end of the keel connection part to place the bulb and the keel connecting part in axial continuity, a cross-sectional shape of the bulb being perpendicular to the longitudinal extent of the bulb, a cross-sectional shape of the connection part being configured to allow the lifting of the bulb with at least one of the two bow and stern ends of the bulb into the keel-storage space of the wheelhouse.

10. The craft according to claim 9, wherein the craft is configured to perform acoustic measurements, the craft further comprising acoustic measurement systems comprising acoustic wave transmitting and receiving transducers, at least the acoustic wave transmitting and receiving transducers are disposed in the bulb of the removable keel.

11. The craft according to claim 2, wherein the craft is configured to perform acoustic measurements, the craft further comprising acoustic measurement systems comprising acoustic wave transmitting and receiving transducers, at least the acoustic wave transmitting and receiving transducers are disposed in the bulb of the removable keel.

12. The craft according to claim 2, further comprising a mechanism configured to lift and lower the removable keel, said mechanism being at least motor-driven.

13. The craft according to claim 2, further comprising a lock configured to lock the removable keel in the lowered position.

14. The craft according to claim 1, further comprising a mechanism configured to lift and lower the removable keel, said mechanism being at least motor-driven.

15. The craft according to claim 1, further comprising a lock configured to lock the removable keel in the lowered position.

16. The craft according to claim 15, wherein the lock is magnetic and controlled, the magnetic lock comprising at least two complementary parts magnetically interacting between each other, one of the parts being disposed on a side of the removable keel, and another one of the parts, functionally complementary, being disposed on a side of the at least one hull.

17. The craft according to claim 1, further comprising a lock configured to lock the removable keel in a lifted position.

18. The craft according to claim 17, wherein the lock is magnetic and controlled, the magnetic lock comprising at least two complementary parts magnetically interacting between each other, one of the parts being disposed on a side of the removable keel, and another one of the parts, functionally complementary, being disposed on a side of the at least one hull.

19. The craft according to claim 1, wherein the removable keel comprises, in a lower end, a longitudinally elongated bulb connected to the upper end of the removable keel by a connection part of the removable keel of longitudinal extent lower than the longitudinal extent of the bulb, the bulb comprises a bow end and a stern end, the bulb being configured to tilt at the lower end of the keel connection part to place the bulb and the keel connecting part in axial continuity, a cross-sectional shape of the bulb being perpendicular to the longitudinal extent of the bulb, a cross-sectional shape of the connection part being configured to allow the lifting of the bulb with at least one of the two bow and stern ends of the bulb into the keel-storage space of the wheelhouse.

20. The craft according to claim 19, wherein the craft is configured to perform acoustic measurements, the craft further comprising acoustic measurement systems comprising acoustic wave transmitting and receiving transducers, at least the acoustic wave transmitting and receiving transducers are disposed in the bulb of the removable keel.

* * * * *